US010464072B2

(12) United States Patent
Guerrero Palma et al.

(10) Patent No.: US 10,464,072 B2
(45) Date of Patent: Nov. 5, 2019

(54) METHOD AND SYSTEM FOR COMMINUTING GRINDING STOCK USING A ROLLER MILL

(71) Applicant: THYSSENKRUPP INDUSTRIAL SOLUTIONS AG, Essen (DE)

(72) Inventors: Pedro Guerrero Palma, Lippetal (DE); Ludwig Könning, Ahlen (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 1276 days.

(21) Appl. No.: 14/415,606

(22) PCT Filed: Jul. 3, 2013

(86) PCT No.: PCT/EP2013/064043
§ 371 (c)(1),
(2) Date: Jan. 19, 2015

(87) PCT Pub. No.: WO2014/012792
PCT Pub. Date: Jan. 23, 2014

(65) Prior Publication Data

US 2015/0224512 A1 Aug. 13, 2015

(30) Foreign Application Priority Data

Jul. 19, 2012 (DE) ..... 10 2012 106 554

(51) Int. Cl.
*B02C 25/00* (2006.01)
*B02C 15/02* (2006.01)
(Continued)

(52) U.S. Cl.
CPC ..... *B02C 25/00* (2013.01); *B02C 15/007* (2013.01); *B02C 15/02* (2013.01); *B02C 23/02* (2013.01)

(58) Field of Classification Search
CPC ..... B02C 15/007; B02C 15/02; B02C 23/02; B02C 25/00
(Continued)

(56) References Cited

U.S. PATENT DOCUMENTS 1,806,077 A * 5/1931 McMurray ..... B02C 15/14 241/119
2,172,317 A * 9/1939 Dickey ..... B02C 25/00 110/103
(Continued)

FOREIGN PATENT DOCUMENTS

CN 102112232 A 6/2011
DE 1763432 A 6/1971
(Continued)

OTHER PUBLICATIONS

German language International Search Report for International patent application No. PCT/EP2013/064043; dated Feb. 4, 2014.
(Continued)

*Primary Examiner* — Shelley M Self
*Assistant Examiner* — Smith Oberto Bapthelus
(74) *Attorney, Agent, or Firm* — thyssenkrupp North America, Inc.

(57) ABSTRACT

The invention relates to a method and an apparatus for comminuting grinding stock with a roller mill, wherein a grinding plate cooperates with at least two grinding rollers and the grinding stock supplied in the mass flow is comminuted between grinding plate and grinding roller. At least two grinding rollers are driven via dedicated drives, wherein a power compensation control is carried out for the drives of the grinding rollers, such that the power of the drives is controlled in a predefined ratio to one another. The power control is then effected by changing the mass flow of the grinding stock supplied to at least one of the grinding rollers.

14 Claims, 5 Drawing Sheets

(51) Int. Cl.
*B02C 23/02* (2006.01)
*B02C 15/00* (2006.01)

(58) Field of Classification Search
USPC ..... 241/33, 34, 35, 36, 37, 117, 119
See application file for complete search history.

(56) References Cited

U.S. PATENT DOCUMENTS 2,909,330 A * 10/1959 Hardinge ..... B02C 15/04 235/144 M
3,556,419 A * 1/1971 Frangquist ..... B02C 15/04 241/119
4,013,235 A * 3/1977 Halloran, Jr. ..... B02C 15/04 241/117
4,210,290 A 7/1980 Andersson et al.
4,382,558 A * 5/1983 Svensson ..... B02C 25/00 241/121
4,442,980 A * 4/1984 Oetiker ..... B02C 4/32 241/143
4,489,895 A * 12/1984 Petersen ..... B02C 15/007 241/119
4,544,102 A * 10/1985 Hahn ..... B07B 13/18 241/24.11
4,611,763 A * 9/1986 Tomiyasu ..... B02C 25/00 241/30
4,640,464 A * 2/1987 Musto ..... B02C 25/00 241/119
4,869,434 A * 9/1989 Folsberg ..... B02C 15/007 241/34
5,180,113 A * 1/1993 Gehrke ..... B02C 23/32 209/139.1
5,244,157 A * 9/1993 Brundiek ..... B02C 15/04 241/119
5,386,945 A * 2/1995 Nose ..... B02C 25/00 241/30
5,875,977 A * 3/1999 Kozlak ..... B02C 25/00 241/107
6,588,690 B1 * 7/2003 Koenig ..... A61L 11/00 241/260.1
6,927,502 B2 * 8/2005 Wobben ..... F03D 7/0204 290/44
7,757,975 B2 * 7/2010 Halbleib ..... B02C 15/04 241/18
7,926,754 B2 * 4/2011 Hoffmann ..... B02C 15/006 241/117
7,954,743 B2 * 6/2011 Guerrero Palma ..... B02C 15/04 241/117
8,038,084 B2 * 10/2011 Dilly ..... B02C 15/04 241/121
8,128,011 B2 * 3/2012 Berger ..... B02C 25/00 241/117
8,262,006 B2 * 9/2012 Berger ..... B02C 15/006 241/119
8,517,296 B2 * 8/2013 Frerich ..... B02C 4/32 241/230
8,833,686 B2 * 9/2014 Ruther ..... B02C 4/02 241/227
9,868,122 B2 * 1/2018 Fornefeld ..... B02C 15/006
2008/0230637 A1 * 9/2008 Havlena ..... B02C 15/007 241/25
2009/0261190 A1 * 10/2009 Hoffmann ..... B02C 15/006 241/63
2010/0012760 A1 * 1/2010 Guerrero Palma ..... B02C 15/04 241/230
2010/0059611 A1 * 3/2010 Berger ..... B02C 15/00 241/30
2010/0193616 A1 * 8/2010 Berger ..... B02C 15/006 241/30
2010/0252667 A1 * 10/2010 Dilly ..... B02C 15/04 241/230
2010/0330217 A1 * 12/2010 Kim ..... C22B 1/005 425/112
2011/0121772 A1 * 5/2011 Berger ..... B02C 15/00 318/504
2011/0139578 A1 * 6/2011 Kheifets ..... B65G 43/08 198/339.1
2012/0126044 A1 * 5/2012 Stone ..... B02C 15/04 241/25
2012/0259451 A1 * 10/2012 Konning ..... B02C 15/006 700/164
2013/0001341 A1 * 1/2013 Lessard ..... B02C 15/006 241/36
2015/0151304 A1 * 6/2015 Guerrero Palma ... B02C 15/007 241/27
2015/0196923 A1 * 7/2015 Fornefeld ..... B02C 15/006 241/30
2015/0224512 A1 * 8/2015 Guerrero Palma ... B02C 15/007 241/15

FOREIGN PATENT DOCUMENTS

DE 2839264 A1 3/1979
DE 3834965 A1 7/1989
DE 4019240 * 1/1991
DE 4019240 A1 1/1991
DE 19702854 A1 * 7/1998 ..... B02C 15/006
DE 102007006092 A1 8/2008
DE 102007041878 B4 3/2009
EP 0180814 A2 5/1986
EP 0180816 A2 5/1986
JP H05329392 A 12/1993
JP 2010517753 A 5/2010
WO 20091087558 A1 7/2009

OTHER PUBLICATIONS

English translation of International Search Report for International patent application No. PCT/EP2013/064043; dated Feb. 4, 2014.
English translation of abstract of DE 4019240 A1.
English translation of abstract of DE 102007006092 A1.
English translation of abstract of DE 19702854 A1.
English translation of abstract of DE 102007041878 B4.
English translation of abstract of DE 1763432 A.
English translation of abstract of EP 0180814 A2.
English abstract of JPH05329392A.

* cited by examiner

METHOD AND SYSTEM FOR COMMINUTING GRINDING STOCK USING A ROLLER MILL

CROSS REFERENCE TO RELATED APPLICATIONS

This application is a U.S. National Stage Entry of International Patent Application Ser. No. PCT/EP2013/064043, filed Jul. 3, 2013, which claims priority to German patent application No. DE 102012106554.3, filed Jul. 19, 2012.

FIELD

The invention relates to a method and an apparatus for comminuting grinding stock with a roller mill, wherein a grinding plate cooperates with at least two grinding rollers, which are driven by dedicated drives, and the grinding stock supplied in the mass flow is comminuted between grinding plate and grinding roller.

BACKGROUND

DE 197 02 854 A1 has already indicated that the individual driven grinding rollers are on one hand coupled to one another in the manner of a rotary drive via the grinding plate and the grinding stock or grinding stock bed located thereon and, on the other hand, can have very different power demands, which are for example due to different rolling diameters on the grinding plate (friction/diameter), different effective diameters of the individual grinding rollers (e.g. through wear) and a different behavior during draw-in of the grinding stock in the cooperation between grinding plate and grinding roller.

Even small changes in rotational speed between individual grinding rollers cause relatively large power variations in the individual drives. This can mean that the grinding rollers are constantly being accelerated or slowed, i.e. the individually driven grinding rollers work against one another, which leads to a substantially higher energy demand during comminuting operation.

DE 197 02 854 A1 therefore proposed equalizing the operating variations between the individual rotational drives of all the driven grinding rollers by means of a common load compensation control.

However, in the case of dynamic changes in transmission between grinding plate and grinding roller, the power demands of the drives are very different. In order to improve the compensation control, in DE 10 2007 006 092 A1 the compensation control consists of a power compensation control, wherein controlling the rotational speed of at least one drive controls the power of the drives in a predefined ratio to one another. According to DE 10 2007 041 878 B4, instead of controlling the rotational speed, the grinding pressure is controlled in order to control the power of the drives in a predefined ratio to one another.

DE 1 763 432 A further discloses a control device for a mill driven by a three-phase electric motor, for automatically controlling the supply of grinding stock for a constant load on the three-phase electric motor. EP 0 180 814 A2 discloses a roller mill with a control system in order to operate the mill over a broad throughput range, which ensures a satisfactory air-solid ratio and a desired degree of fineness.

SUMMARY

One object of the present disclosure is to develop a new concept for a power compensation control.

BRIEF DESCRIPTION OF THE DRAWINGS

The present disclosure is described in detail below with reference to the attached drawing figures, wherein.

DETAILED DESCRIPTION

Figure 1:
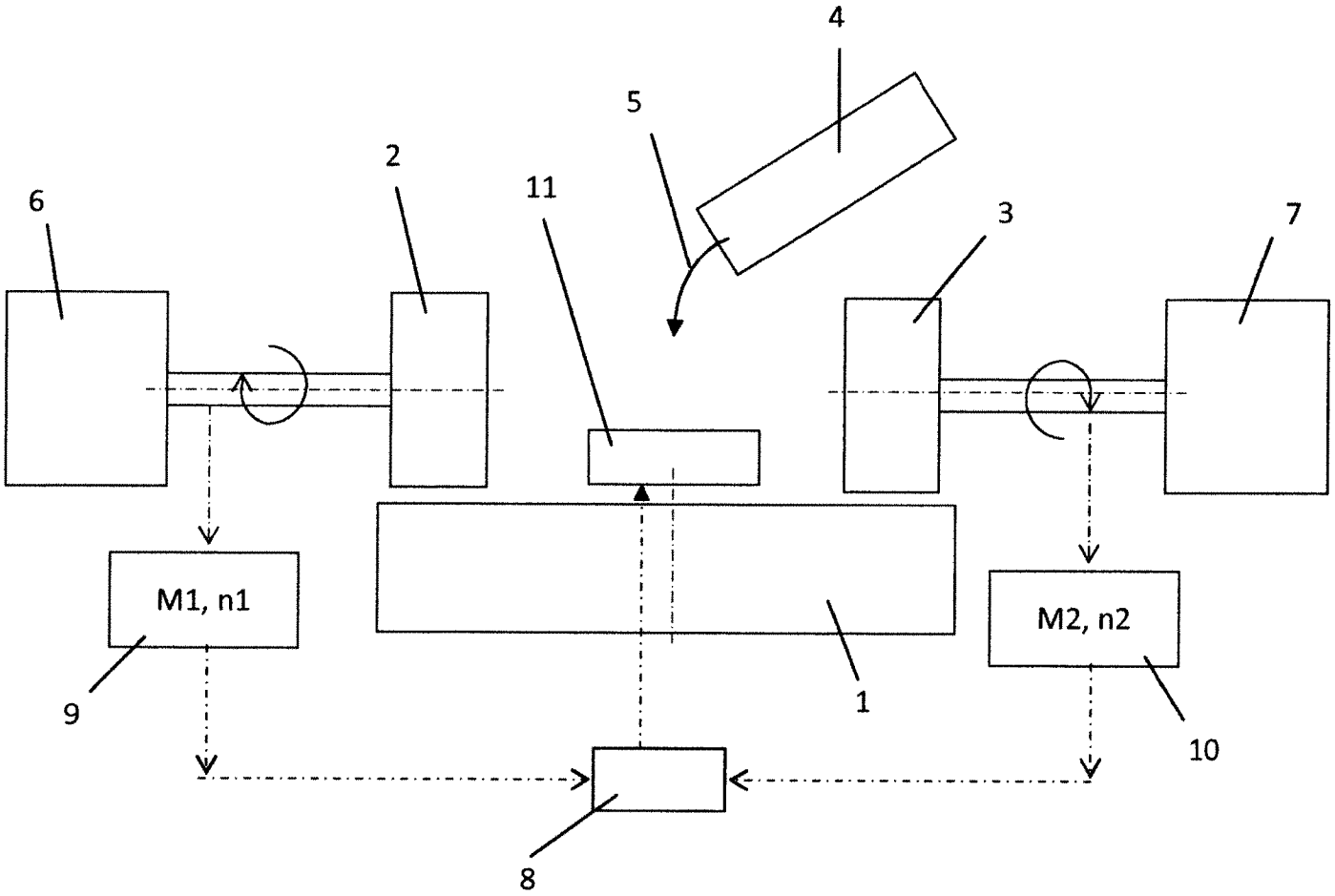
FIG. 1 is a schematic diagram of an embodiment of an apparatus of the present disclosure for comminuting grinding stock using a roller mill and a power compensation control device.

In the method according to the invention for comminuting grinding stock with a roller mill, a grinding plate cooperates with at least two grinding rollers, wherein the grinding stock supplied in the mass flow is comminuted between grinding plate and grinding roller. At least two grinding rollers are driven via dedicated drives, wherein a power compensation control is carried out for the drives of the grinding rollers, such that the power of the drives is controlled in a predefined ratio to one another. The power control is then effected by changing the mass flow of the grinding stock supplied to at least one of the grinding rollers.

The apparatus according to the invention for comminuting grinding stock with a roller mill has a grinding plate and at least two grinding rollers cooperating with the grinding plate, wherein the grinding stock supplied in the mass flow is comminuted between grinding plate and grinding roller, and wherein at least two grinding rollers have a dedicated drive and a power compensation control device for the drives of the grinding rollers is provided for controlling the power of the drives in a predefined ratio with respect to one another. The power compensation control device cooperates with at least one actuator in order to change the mass flow of the grinding stock supplied to at least one of the grinding rollers.

The term "mass flow" is understood as the material flow rate or the mass flow rate which is delivered, via a delivery device, generally onto the center of the grinding plate and is then fed to the grinding rollers. While the power compensation controls known from the prior art act directly on the grinding rollers by controlling the rotational speed or the grinding pressure, the concept according to the invention proposes, for the purpose of power compensation control, influencing the mass flow rate.

Further embodiments of the invention form the subject matter of the subclaims.

The power compensation control preferably uses the torque and/or the rotational speed of the drives as a control variable. The mass flow can in particular be changed by influencing the orientation of the mass flow with respect to the grinding roller and/or influencing the breadth of the mass flow and/or influencing the height of the mass flow and/or influencing the quantity supplied. It can also be provided to pre-compress or loosen the grinding stock supplied in the mass flow.

Further possibilities for changing the mass flow consist in changing the chemical and/or physical properties of the grinding stock. It is in particular conceivable to change the composition by adding grinding assistants and/or water and/or additives. It is also possible to add coarse material and/or fresh material and/or circulating material and/or smalls and/or finished material, in particular from a subsequent sifting process, in order to change the mass flow.

The power compensation control device is, expediently, operatively connected to torque sensors in order to detect the torque of the drives of the grinding rollers and/or to rotational speed sensors in order to detect the rotational speed of the drives of the grinding rollers, in order to then control, depending on the measurement result, at least one actuator for changing the mass flow. These actuators may for example consist of guiding elements, adjustable chutes, adjustable height limits and dosing devices.

For the drives of the grinding rollers, unregulated three-phase asynchronous electric motors are particularly suitable. The power of the drives can fundamentally be controlled such that the operating torques of the drives lie between zero and the breakdown torque of the drives. It is thus possible for the drives of the grinding rollers to be adapted to the respective grinding requirements, within a broad range.

Further advantages and embodiments of the present disclosure are explained in more detail below with reference to the description and the attached drawing figures.

The apparatus for comminuting grinding stock with a roller mill, as represented in FIG. 1, has a grinding plate 1 and at least two grinding rollers 2, 3 cooperating with the grinding plate, wherein the grinding stock 5 supplied in the mass flow via a delivery device 4 is comminuted between grinding plate and grinding roller. Each of the two grinding rollers 2, 3 has a dedicated drive 6, 7, while the grinding plate in the represented exemplary embodiment is driven via the grinding rollers 2 and 3 and the grinding stock 5 and hence no dedicated drive is assigned thereto. Within the scope of the invention, it is however also possible for the grinding plate to be additionally driven. Moreover, a power compensation control device 8 is provided, which cooperates with measuring units 9, 10 and at least one actuator 11. The measuring units 9, 10 are for example torque sensors for detecting the torque M1, M2 of the drives 6 or 7 and/or rotational speed sensors for detecting the rotational speed n1, n2 of the drives 6, 7. Using the measured values, the power compensation control device 8 can determine the power of the two drives 6, 7. The total power of all the drives is to be shared out between the individual drives in a predefined ratio. In that context, it can for example be provided that all drives are operated with the same power. It is however entirely conceivable that the powers are shared out differently, which can for example be the case with grinding rollers of different sizes.

The power compensation control device controls the power of the individual drives such that the powers lie in a predefined setpoint range. If it is established, via the measurement values (rotational speed, torque), that the power of one or other of the drives lies outside the setpoint range, the actuator 11 is used to influence, in a targeted manner, the mass flow of the grinding stock 5 supplied to at least one of the grinding rollers 2, 3. One such example might be that less grinding stock is supplied to the grinding roller whose drive power is elevated than to the grinding roller whose drive is consuming relatively too little power. It is thus possible to influence, in a targeted manner, the power of both drives 6, 7 by changing the mass flow, in order to control the power of both drives in the predefined ratio of for example 50% each.

By virtue of this control, it is not necessary for the drives 6, 7 to be equipped with expensive control devices such as frequency rectifiers. Unregulated three-phase asynchronous electric motors are thus preferably used as drives 6, 7.

The above-described apparatus is particularly suited to comminuting grinding stock such as limestone, binders and coal. The roller mill can for example be configured as follows:

diameter of the grinding plate 1: 2 m to 8 m,
diameter of the grinding roller 2, 3: 1 m to 4 m,
rated power of the drives 6, 7: 100 kW to 4000 kW.

Some exemplary embodiments for influencing the mass flow are presented in more detail below, wherein in all exemplary embodiments in each case at least two driven grinding rollers are provided. Merely for reasons of clarity, the grinding roller 3 and the associated drive 7 are not represented in the drawing. Furthermore, the same reference signs have been used for identical components.

Figure 2:
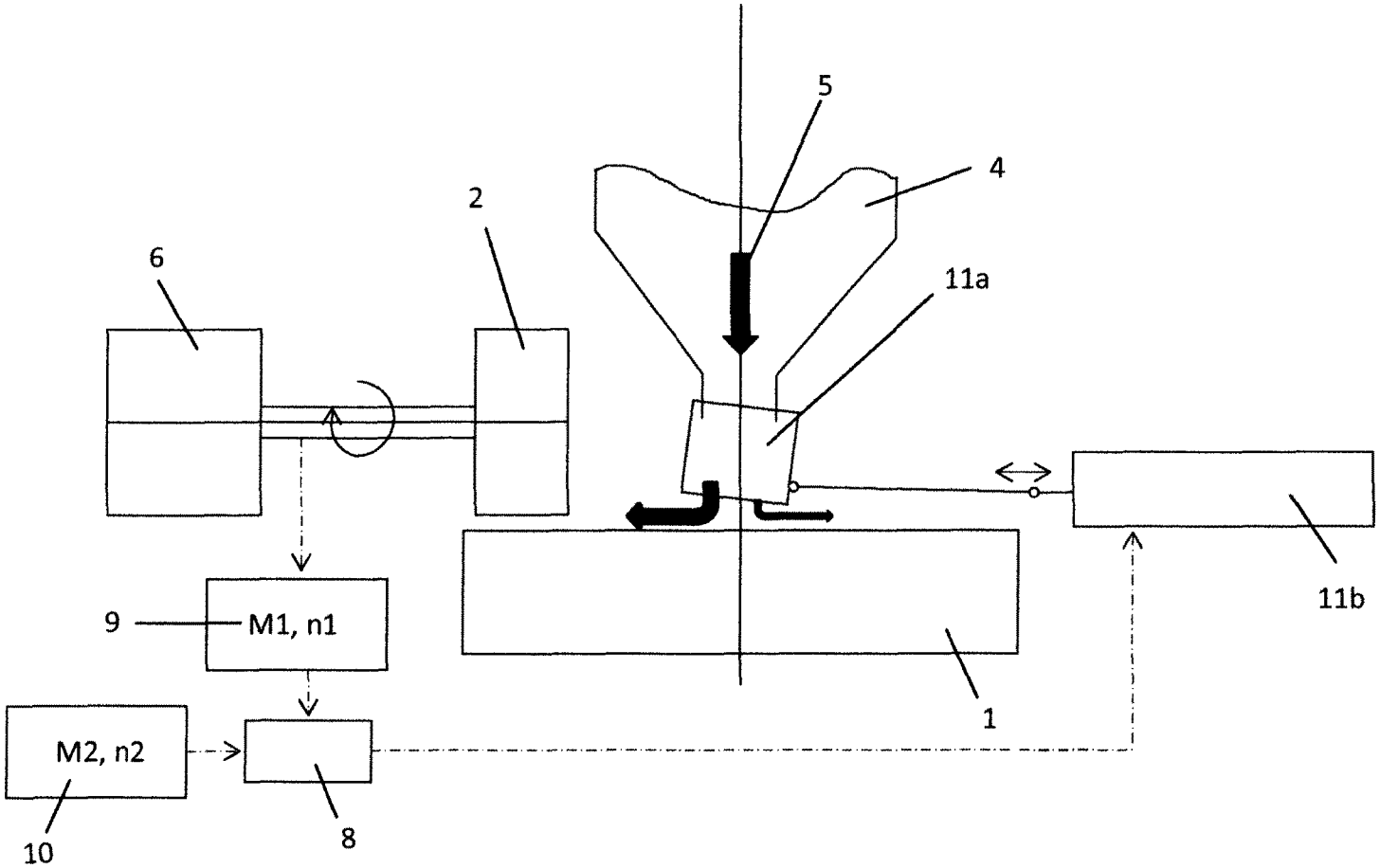
FIG. 2 is a schematic diagram of the apparatus of FIG. 1 in which the power compensation control device cooperates with a pivotable chute.

In the exemplary embodiment according to FIG. 2, the actuator is formed by a pivotable chute 11*a* provided at the lower end of the delivery device 4, which chute can be made to pivot by means of an actuating drive 11*b*. Depending on the position of the pivotable chute 11*a*, the quantity of the mass flow to the two grinding rollers 2, 3 can be influenced. The power compensation control device 8 will thus control the actuating drive 11*b* accordingly, as a function of the measurement values determined by the measuring units 9, 10, if the powers of the two drives 6, 7 lie outside their predefined control ranges.

Figure 3:
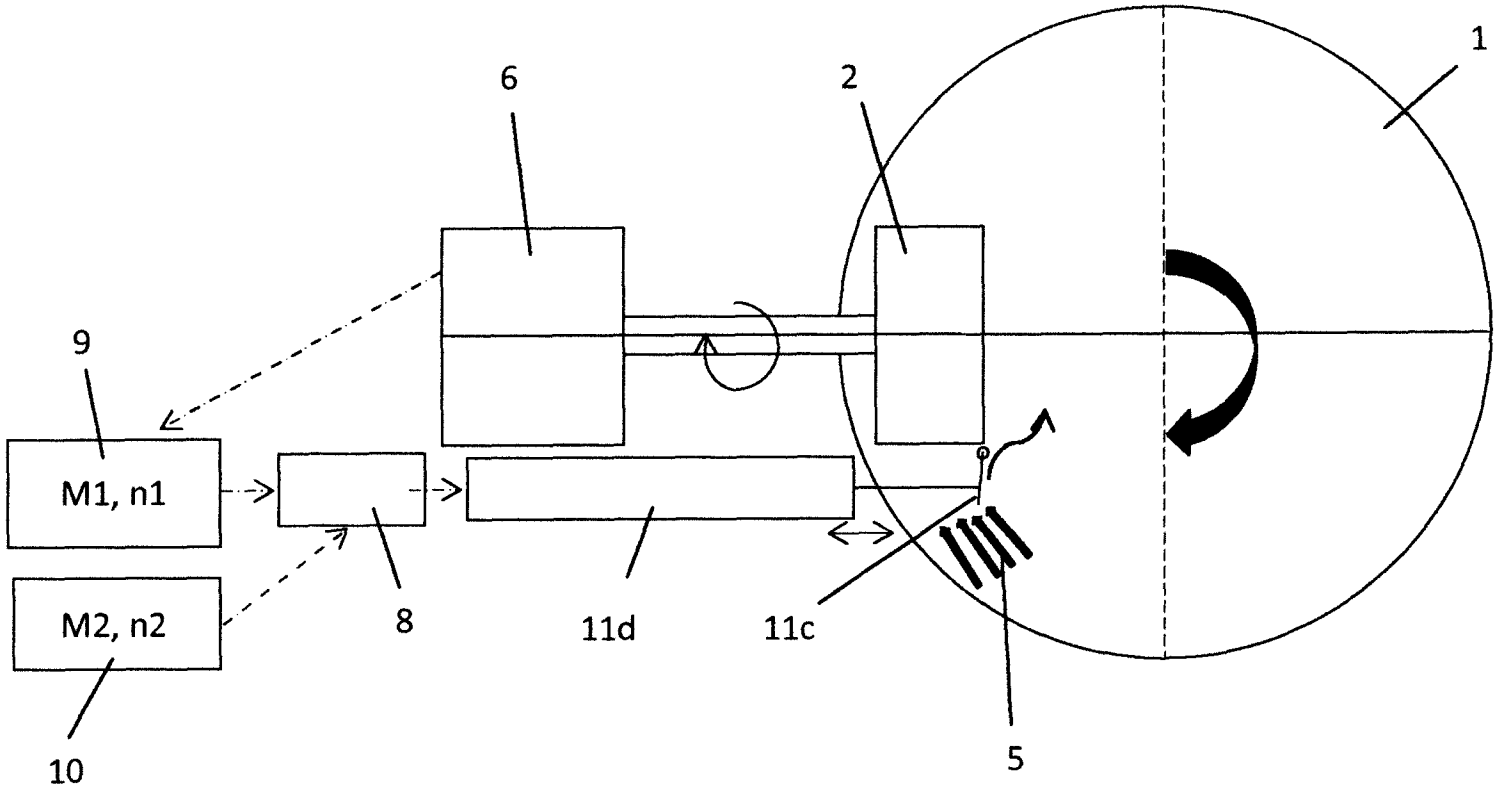
FIG. 3 is a schematic diagram of the apparatus of FIG. 1, wherein the power compensation control device cooperates with an adjustable guide plate.

In the exemplary embodiment according to FIG. 3, the actuator is formed by an adjustable guide plate 11*c* with an associated actuating drive 11*b*. By means of this guide plate 11*c* it is in particular possible to influence the orientation of the mass flow with respect to the grinding roller and/or the breadth of the mass flow and/or the quantity supplied.

Figure 4:
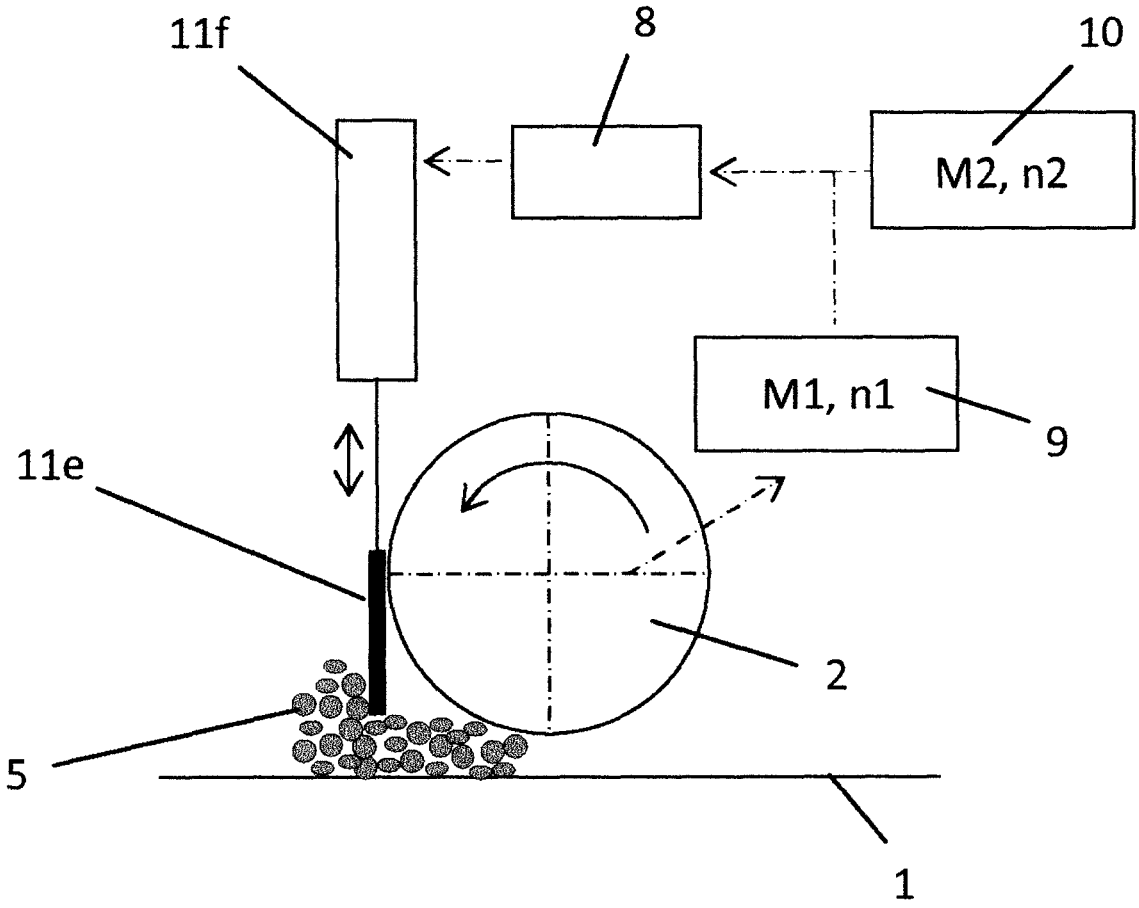
FIG. 4 is a schematic diagram of the apparatus of FIG. 1, wherein the power compensation control device cooperates with an adjustable height limiting element.

FIG. 4 shows the variant in which the mass flow is changed by influencing its height. To that end, the actuator is formed by a height limiting element 11*e* whose height can be set, by means of an actuating drive 11*f*, by the power compensation control device 8.

Figure 5:
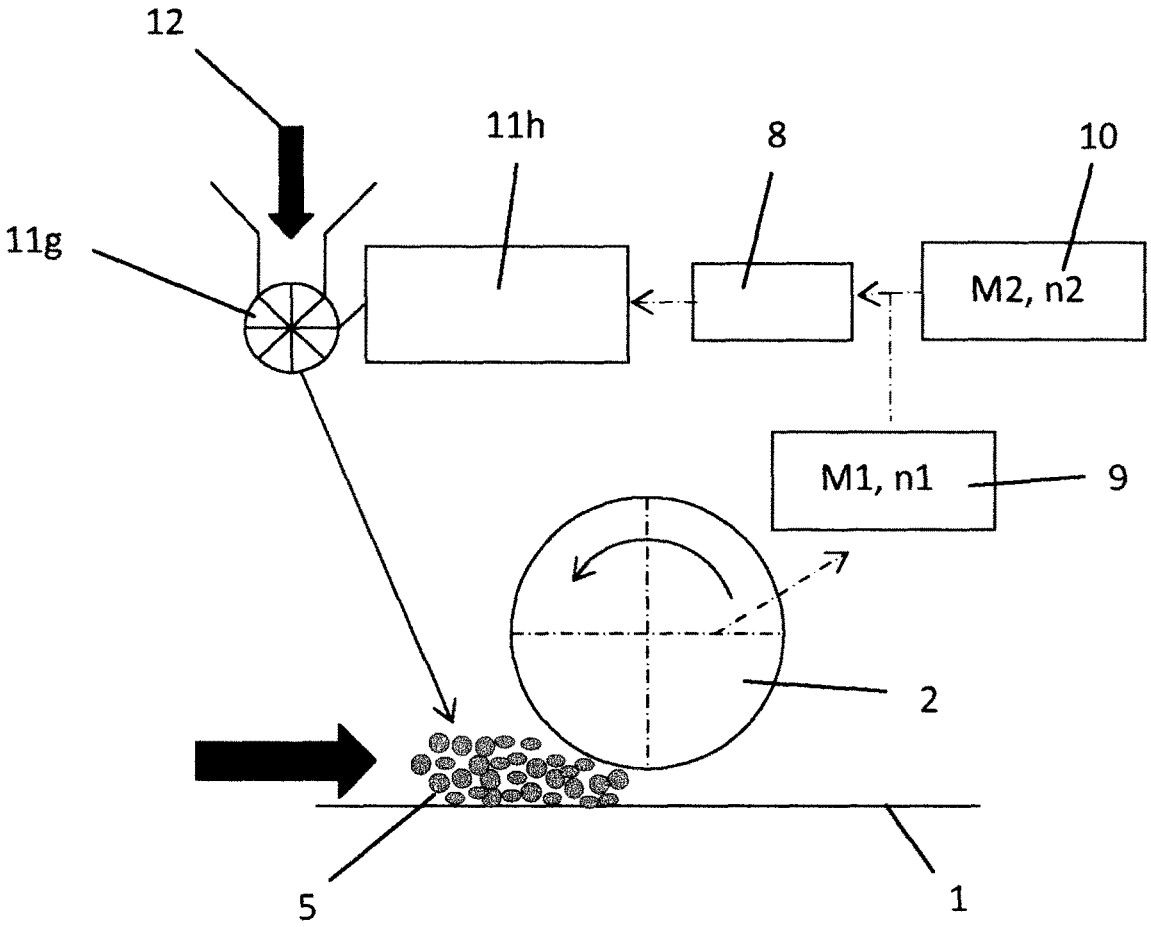
FIG. 5 is a schematic diagram of the apparatus of FIG. 1, wherein the power compensation control device cooperates with a device for adding additives.

In the exemplary embodiment according to FIG. 5, the mass flow is influenced by changing its composition. To that end, the actuator consists of a dosing device 11*g* with an associated actuating drive 11*h*, wherein admixtures such as fresh material, circulating material or finished material, smalls, additives, water or grinding assistant are added to the grinding stock 5 by means of the dosing device 11*g*. If this addition is effected in a targeted manner upstream of a grinding roller, the power demand of the associated drive can be influenced in a targeted manner.

Within the context of the invention, many other possibilities for influencing the mass flow are of course conceivable. Thus, for example, what is termed a slave roller can be connected upstream of each grinding roller, which slave roller makes it possible, by means of a variable contact pressure, to pre-compress the grinding bed and thus to influence the power demand of the drives of the associated grinding rollers. It is also conceivable to loosen the grinding bed, for example by means of fluidizing air.

The above described power compensation control is on one hand very effective and is substantially more cost-effective than the rotational speed control known from the prior art.

The invention claimed is:

1. A method for comminuting grinding stock with a roller mill, the method comprising a grinding plate cooperating with at least two grinding rollers to comminute grinding stock between the grinding plate and the at least two grinding rollers, wherein the at least two grinding rollers are driven via dedicated drives and a power compensation control is carried out for the drives of the at least two grinding rollers such that power consumption of the drives is controlled in a predefined ratio to one another, wherein controlling the power consumption is effected by changing a mass flow of the grinding stock supplied to at least one of the at least two grinding rollers such that a first mass flow of the grinding stock delivered to a first grinding roller of the at least two grinding rollers is different from a second mass flow of the grinding stock delivered to a second grinding roller of the at least two grinding rollers.

2. The method as claimed in claim 1 wherein a torque and/or a rotational speed of the drives is used as a control variable for the power compensation control.

3. The method as claimed in claim 1 wherein changing the mass flow of the grinding stock comprises at least one of influencing an orientation of the first mass flow of the grinding stock with respect to the first grinding roller, influencing a breadth of the first mass flow of the grinding stock with respect to the first grinding roller, or influencing a height of the first mass flow of the grinding stock with respect to the first grinding roller.

4. The method as claimed in claim 1 comprising pre-compressing the grinding stock supplied in the first mass flow to the first grinding roller.

5. The method as claimed in claim 1 comprising loosening the grinding stock supplied in the first mass flow to the first grinding roller.

6. The method as claimed in claim 1 wherein the power consumption of the drives is controlled such that an operating torque of each of the drives lies between zero and a breakdown torque of the drives.

7. The method as claimed in claim 1 wherein changing the mass flow of the grinding stock comprises changing a composition of the grinding stock in at least one of the first or second mass flows.

8. The method as claimed in claim 7 wherein the composition of the grinding stock is changed by adding grinding assistants and/or water and/or additives.

9. The method as claimed in claim 7 wherein the composition of the grinding stock is changed by adding coarse material and/or fresh material and/or circulating material and/or smalls and/or finished material.

10. The method of claim 1, comprising changing the first mass flow of the grinding stock supplied to the first grinding roller by influencing a volumetric rate at which the grinding stock is supplied to the first grinding roller.

11. The method of claim 1 wherein changing the mass flow of the grinding stock is effected by at least one of influencing an orientation of only the first mass flow of the grinding stock, influencing a breadth of only the first mass flow of the grinding stock, or influencing a height of only the first mass flow of the grinding stock.

12. An apparatus for comminuting grinding stock, the apparatus comprising a roller mill which has a grinding plate and at least two grinding rollers cooperating with the grinding plate, wherein the grinding stock is comminuted between grinding plate and the at least two grinding rollers, wherein the at least two grinding rollers each have a dedicated drive and wherein a power compensation control device for the drives of the at least two grinding rollers is provided for controlling power consumption of the drives in a predefined ratio with respect to one another, wherein the power compensation control device cooperates with at least one actuator to change a mass flow of the grinding stock supplied to at least one of the at least two grinding rollers such that a first mass flow of the grinding stock delivered to a first grinding roller of the at least two grinding rollers is different from a second mass flow of the grinding stock delivered to a second grinding roller of the at least two grinding rollers.

13. The apparatus as claimed in claim 12 wherein the power compensation control device is operatively connected to at least one of torque sensors to detect a torque of each of the drives rotational speed sensors to detect a rotational speed of each of the drives.

14. The apparatus as claimed in claim 12 wherein the drives are unregulated three-phase asynchronous electric motors.

* * * * *